US005675115A

United States Patent [19]

Hershkowitz et al.

[11] Patent Number: 5,675,115

[45] Date of Patent: Oct. 7, 1997

[54] IGNITION TUBE FOR ELECTROTHERMAL CHEMICAL COMBUSTION

[75] Inventors: Joseph Hershkowitz, West Caldwell, N.J.; Roderick King, Saylorsburg, Pa.; Donald Chiu, Jamaica, N.Y.

[73] Assignee: The United States of America as represented by the Secretary of the Army, Washington, D.C.

[21] Appl. No.: 627,862

[22] Filed: Apr. 3, 1996

[51] Int. Cl.[6] ..... F42C 19/08

[52] U.S. Cl. ..... 102/202; 102/200; 102/275.11; 89/8

[58] Field of Search ..... 89/8; 102/202, 102/200, 275.11, 202.9, 470, 202.7; 60/380

[56] References Cited

U.S. PATENT DOCUMENTS

| | | | |
|---|---|---|---|
| H1352 | 9/1994 | Bundy et al. | 102/202 |
| 2,424,993 | 8/1947 | Meister | 102/202 |
| 3,224,373 | 12/1965 | Kramer | 102/202 |
| 3,332,353 | 7/1967 | Burkhardt | 102/202 |
| 4,495,866 | 1/1985 | Brede et al. | 102/202 |
| 5,072,647 | 12/1991 | Goldstein et al. | 89/8 |
| 5,355,764 | 10/1994 | Marinos et al. | 89/8 |

*Primary Examiner*—Michael J. Carone
*Assistant Examiner*—Christopher K. Montgomery
*Attorney, Agent, or Firm*—Earl T. Reichert; Edward Stolarun; John E. Callaghan

[57] ABSTRACT

An ignition tube for use with electrothermal chemical combustion ignition of projectiles in guns, comprising a tube positionable in a combustion chamber for receiving plasma ignition from a plasma chamber. The tube is formed from high density polyethylene or other materials adapted to release plasma upon contact by plasma ignition electrical energy or pulses. The tube is specifically designed to provide an increasing exit area from the proximal end of the tube toward the distal so as to act upon the longitudinally attenuated plasma, thereby substantially decreasing the amplitude of any reflected shock in the plasma stream. The exit area comprises a plurality of radially extending orifices or holes that have a decreased angle of inclination to the longitudinal axis from proximal end to distal end, such that the orifices form a spiral pattern on the circumference of the tube. This pattern provides a uniform action of plasma on the propellant over the entire length of the ignition tube. A combination of spiral hole pattern and decreasing angle of inclination to the longitudinal axis facilitates exit of the plasma from the combustion chamber to act on the propellant and thus on the projectile. Simultaneously with this advantage is the creation of turbulence at the plasma-propellant interface to improve local site ignition.

18 Claims, 1 Drawing Sheet

IGNITION TUBE FOR ELECTROTHERMAL CHEMICAL COMBUSTION

The invention described herein may be manufactured, used, and licensed by or for the U.S. Government for U.S. Governmental purposes.

FIELD OF THE INVENTION

The present invention relates generally to electrothermal chemical combustion for increasing muzzle velocity of a projectile exiting from a gun such as a cannon, howitzer and the like. More particularly, the invention relates to an improved ignition tube for use with an electrothermal chemical combustion gun.

BACKGROUND OF THE INVENTION

It has been known to increase the muzzle velocity of a projectile exiting a gun, such as a cannon or howitzer for example, by supplementing and tailoring the chemical energy released from the propellant by controlled addition of electrical energy. This is accomplished by electrothermal chemical combustion.

This form of combustion has the additional benefit of allowing the use of less vulnerable, or less easily ignited, propellants because plasma ignition is quite powerful.

Plasma ignition is achieved from a pulse forming network, wherein plasma that is made to impinge upon a propellant so as to ignite it and modify its burning rate. A critical feature of this process is the created interaction between the plasma and the propellant, as it is this feature that provides the augmented pressure-time wave form.

To achieve a useful gun propellant, the objective is to have the plasma ignite the propellant in the contacting region sufficiently uniformly that no pressure spikes or traveling waves are created. These waves could damage the cannon or its sophisticated payload, or lead to non-reproducibility of firings. As the plasma burns, the plasma wave form must be such that in conjunction with the provided interaction mechanism, energy is added in the appropriate quantity to provide the desired pressure-time wave form.

At the present time, however, no single design has been provided that is capable of controlling the interaction of all plasmas on all the fluid propellant so as to meet these desired requirements.

Present day electrothermal chemical combustion guns include a plasma chamber into which an electrical discharge is made. The discharge is passed into a combustion chamber that contains a quantity of propellant, so as to provide ignition thereof. In prior art designs, no real success has been achieved in modulating the interaction of plasma and propellant.

The use of a centrally located ignition tube for such guns is not new. In fact, a plurality of associated problems have been discovered with the use of such an insert. A strong pressure gradient develops between the plasma cartridge and the combustion chamber, thereby driving the plasma via the ignition tube into the propellant at a propagation velocity down a center core igniter of the order of 1800 m/s. Such center core igniter actions bursts the tube uniformly along the entire length, the thus generated turbulence significantly alters the pressure profile.

Various problems have been discovered in experimentally designed electrothermal chemical combustion guns, particularly with regard to the passage of the plasma pulses and the resulting interaction with the flow of propellant. It would be of great advantage to the art if an insert could be developed that would permit control over the plasma pulses, the propellant, and the interaction there between such that reproducible ignition of the propellant and maximum combustion thereof is attained.

Accordingly, one object of the present invention is to provide an electrothermal chemical combustion system in which plasma ignites the propellant in the contacting region sufficiently uniformly that no substantial pressure spikes or traveling waves are created.

Another object of this invention is to provide an ignition tube that is capable of modulating the interaction of plasma and propellant to provide a desired pressure-time wave form.

An additional object of this invention is to provide an interaction of plasma and propellant that is reproducible.

Yet another object of this invention is to provide an ignition tube that maximizes the energy produced from the propellant.

Other Objects will appear hereinafter.

SUMMARY OF THE INVENTION

It has now been discovered that the above and other objects of the present invention may be accomplished in the following manner. Specifically, it has now been discovered that an improved gun for firing projectiles using electrothermal chemical combustion may be provided.

The gun includes a plasma chamber adapted to release plasma ignition electrical energy pulses along a longitudinal axis. Also provided is a combustion chamber for receiving said plasma ignition pulses from said plasma chamber. Finally, an ignition tube is positioned in said chamber, said tube having a proximal end for receiving said pulses in said combustion chamber and a distal end for association with said projectile.

The ignition tube of the present invention is particularly adapted to accomplish the objects of this invention. The tube of this invention has a central bore and an increasing exit area from said bore extending from said proximal end toward said distal end. The exit area includes a plurality of radially extending orifices having a decreased angle of inclination to the longitudinal axis from the proximal end to the distal end of the tube. Thus, the orifices form a spiral pattern on the circumference of the tube.

The tube is formed from high density polyethylene or other materials adapted to release plasma upon contact by plasma ignition electrical energy or pulses. Although any material of construction that moderates plasma when pulsed with plasma ignition electrical energy pulses is suitable, the preferred ignition tube is formed from high density polyethylene. The material should be rigid and capable of transmitting infrared pulses caused by radiative ignition. Examples of other materials are lexan and mylar.

In a preferred embodiment, the orifices are oriented to uniformly act upon the longitudinally attenuated plasma, thereby substantially decreasing the amplitude of any reflected shock in the plasma stream. The orifices are oriented in a pattern with increasing orifice proximity and decreasing angle of inclination to the longitudinal axis to facilitate exit of the plasma from the combustion chamber to act on the propellant and thus on the projectile. This pattern provides a substantially uniform action of plasma on the propellant over the entire length of the ignition tube. The pattern is also capable of creating turbulence at the plasma-propellant interface to improve local site ignition. In its preferred form, the orifices are oriented in a spiral pattern to form said pattern to fine tune the design to meet specific conditions of propellant and plasma.

The invention allows the use of a much wider range of sensitivity of the propellant, so that more severe or more insensitive propellants may be used. As will be shown below, the precise design of the spacing and tapered diameters will vary according to the specific plasma source and the sensitivity of the propellant.

BRIEF DESCRIPTION OF THE DRAWINGS

For a more complete understanding of the invention, reference is hereby made to the drawings, in which.

DETAILED DESCRIPTION OF THE PREFERRED EMBODIMENT

Figure 1:
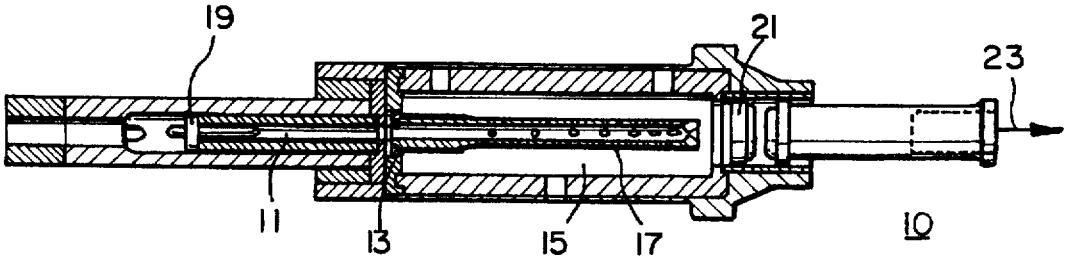
FIG. 1 is a side elevational view, in section, of an ETC Gun with internal components, in accordance with this invention.

FIG. 1 illustrates an electrothermal chemical combustion gun in schematic form, showing the basic components thereof. The gun, 10 generally, has at its proximal end a plasma chamber 11 in which a pulse forming network creates an electrical discharge. Plasma chamber 11 includes a polyethylene capillary so that the discharge of electrical energy releases ions from the capillary wall creating a plasma. The plasma pulse is sent through a hole in the cathode 13 into a combustion chamber 15 that contains the desired quantity of propellant. An ignition tube 17 directs the plasma to the contacting surface of the propellant to provide ignition and then modulates the further interaction of plasma and propellant.

Some guns of this general configuration with base ignition have been tested and found to produce electrothermal ignition of the propellant, but the results have not been satisfactory. In some cases, the ignition has caused pressure spikes or traveling waves that were strong enough to potentially damage the cannon or a payload, particularly if the payload was highly sophisticated. None produced reproducibility of firings or uniform pressure/time (P/T) traces along the gun.

Figure 2:
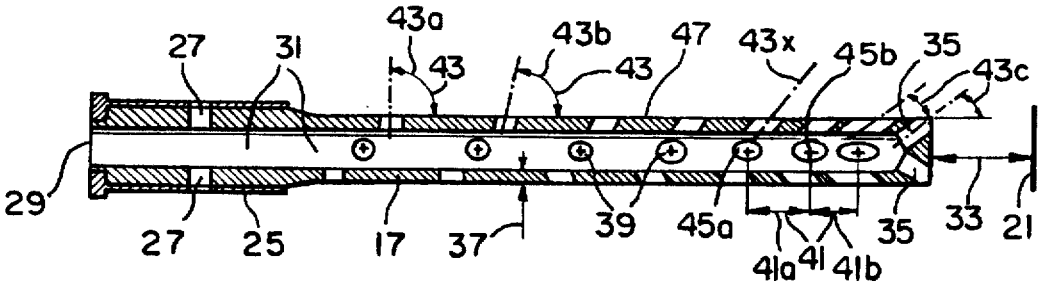
FIG. 2 is an enlarged, side elevational view, in section, of the ignition tube element shown in the device of FIG. 1.

Shown in FIG. 1 and in detail in FIG. 2 is the ignition tube 17 of the present invention. This ignition tube 17 is admirably suited to produce combustion of the propellant such that the plasma wave form is such as to add energy in the appropriate quantity to provide the desired pressure-time wave form without pressure spikes or traveling waves. Tube 17 is made from a material that is adapted to release plasma upon contact by plasma ignition electrical energy or pulses. Although any material of construction that produces plasma when pulsed with plasma ignition electrical energy pulses is suitable, the preferred ignition tube is formed from high density polyethylene. As radiative ignition is transmitted from the plasma through the polyethylene, it contributes to the ignition process and the subsequent modulation of the propellant burning. The polyethylene interior surface and that of the orifices, described herein below, is acted upon by the plasma to provide additional ions to reinforce the plasma.

As shown in FIG. 1, ignition tube 17 is supplied with plasma via plasma generator 19, flowing from plasma chamber 11 through cathode hole 13 into the ignition tube 17 as it is positioned in combustion chamber 15. As the propellant burns, the resulting energy is directed to the projectile 21 along longitudinal axis 23, thus propelling the projectile toward its intended target.

Ignition tube 17 includes a steel sleeve 25 as a reinforcement, whereby sleeve 25 has a length of approximately three (3) times the outside diameter of ignition tube 17. Sleeve 25 includes a pair of radial holes 27 that are spaced 180° apart. The interior of steel sleeve 25 adjacent to the cathode 13 is protected from the plasma flow by a rearward extension 29 of ignition tube 17. Steel sleeve 25 and the two release holes 27 prevent bursting of tube 17 in the base region 29 where very high plasma pressure exists.

In the preferred embodiment, the plasma chamber capillary 11, the cathode hole 13 and the interior diameter 31 of ignition tube 17 all have the same diameter in order to prevent nozzle effects on the flow of plasma during operation of the gun. For a 20 mm gun, the diameter 31 will be 0.475 cm, (0.187 inches). Of course, when a different caliber gun is employed, this diameter 31 will also be suitably changed.

For a 20 mm gun, the ignition tube 17 is preferably 9.87 cm (3.89 in) long, and is positioned such that the distance 33 from the distal end of ignition tube 17 to the projectile 21 is 1.5 times the outer diameter of the tube 17. Ignition tube 17 is constructed with a wall thickness 37 of 0.158 cm (0.062 in), which is approximately ⅓ of inner diameter 31 of tube 17, so the outer diameter for this embodiment for a 20 mm gun is 0.792 cm (0.312 in). Distance 33, in this example, is 1.5 times the outside diameter, or 1.888 cm (0.468 in).

An important element of the present invention is the design of the orifices or holes that are positioned in ignition tube 17 to permit the plasma to contact the propellant contained in combustion chamber 15. Two plasma relief holes 27, previously described, extend at the proximal end of tube 17 in a radially outward direction. At the distal end of tube 17 a second pair of holes 35 are provided, such that holes 35 are inclined at 30° to longitudinal axis 23. Orifices 35 act on the longitudinally attenuated plasma, venting it toward projectile 21. By the presence and orientation of orifices 35, the amplitude of any reflected shock in the plasma stream is decreased.

Located between proximal end holes 27 and distal end orifices 35 are a plurality orifices or holes 39. The spacing 41 between holes 39 decreases from proximal end to distal end, as shown by dimensions **41*a* and 41*b*. In addition, the angle of inclination 43 to the longitudinal axis 23 of the holes 39 decreases from 90° to 30°, as shown by angle 43*a*, 43*b* and 43*x*. As a result of the decreasing angle of inclination 43, the exit area 45 of the orifices 39 increases, illustrated by areas 45*a* and 45*b*, as the plasma flow is attenuated. Orifices 39 also form a spiral pattern on circumference 47 of tube 17 as the changes in spacing 41 and angle of inclination 43 are simultaneously altered. This pattern provides a substantially uniform ignition and combustion action of plasma on propellant over the entire length of the ignition tube 17. The plasma flow in the direction of projectile motion favors maintaining plasma-propellant interaction during initial projectile motion. This oriented flow provides a dynamic pressure that acts against a backward flow of propellant gasses into the capillary of plasma chamber 11**. The spiral hole pattern induces a rotational moment in the plasma stream and, with the other hole pattern features, facilitates exit of the plasma to act on the propellant. At the same time the flow tends to generate turbulence at the plasma-propellant interface, improving "local site ignition." In this embodiment shown in FIG. 2, the ratio of hole normal-to-flow area to the interior surface area of the ignition tube is 13%.

The present invention is intended for use with a wide variety of propellants. For propellants that are liquids, powders or many very small grains, the exterior surface of ignition tube 17 may be covered with a thin film, such as "Scotch tape" for example, to prevent flow of the propellant into the ignition tube 17 prior to firing. For solid grain coaxial propellants, the interior dimension of the grains is made two wall thicknesses greater than the outer diameter of the ignition tube. This provides space for formation of a plasma sheath between the ignition tube and the solid propellant.

The preferred embodiment shown in FIG. 2 is a 20 mm gun, used herein to illustrate the features of the invention. It should be noted that the principles of the invention apply equally to guns of other dimensions. The design set forth herein provides a set of values that can be scaled for other dimension guns. Fine tuning of the dimensions is also desired, as shown below.

The specific embodiment in FIG. 2 has 28 holes or orifices 39 having a diameter of 0.276 cm (0.109 in) in addition to proximal end holes 27 and distal end holes 35, also of that diameter. The spiral pattern of orifices or holes is produced by moving 90° around circumference 47 between successive holes. The hole spacing 41 is decreased every 4th hole, or every 360° from the base or proximal end toward projectile 21. Of course, for larger dimension ignition tubes with many more holes, the spacing may be uniformly altered between all the holes. The spacings for the embodiment shown in FIG. 2 are 0.356 (0.140), 0.318 (0.125), 0.277 (0.109), 0.239 (0.094), 0.198 (0.078), and 0.160 cm (0.063 in), respectively. The inclination 43 of the holes starts at 90° to the longitudinal axis 23 and changes about 10° toward the projectile 11 with every 4th orifice 39. Again, this increment can also be made more uniform for larger dimension ignition tubes. The length of steel sleeve 25 is 2.22 cm (0.875 in). The outer and inner diameters of tube 17 are 0.792 cm (0.312 in) and 0.475 cm (0.187 in) respectively. The overall length of ignition tube 17 is 9.87 cm (3.89 in).

It is contemplated that the present invention is suitable for a wide range of sizes of guns. For applying this invention to larger guns, it is appropriate to follow the following procedure. Gun design will have specified the plasma chamber capillary inner diameter in accordance with the available or planned pulse forming network, or will have defined the desired ratio of plasma energy to propellant energy. This inner diameter thus becomes the inner diameter of the tube being designed. The ignition tube wall thickness is then selected to the minimum thickness that provides adequate structural strength for that ignition tube length. It should be in the range between that of the 20 mm gun as described above, namely 0.258 cm (0.062 in) and ⅓ of the inner diameter 31 of the ignition tube 17. The steel sleeve reinforcement 25 at the base is made approximately 3 outer diameters long. A pair of orifices or holes 27 are provided at 90° to longitudinal axis 23, spaced 180° apart for every 2 cm of length. Multiple pairs are rotated on the circumference 47 with respect to each other so as to provide optimum plasma pressure release in the region of steel sleeve 25.

The gun design will also have specified the combustion chamber 15 dimensions to provide the desired quantity of propellant. The length of the ignition tube 17 is set so that the end of the tube is ⅔ the outer diameter of tube 17 from the obturator. The spiral hole pattern described for FIG. 2 is first scaled to the greater length of tube 17 for the new design. As the length increases, the individual hole diameter is maintained the same, i.e. 0.276 cm (0.109 in). The 28 holes are spaced 41 further apart with spacing between them decreasing from proximal to distal end, but with the ratios given above multiplied by the ratio of the length of exposed tube of new design to that of the tube in FIG. 2, namely 7.62 cm (3 in). The turns of the spiral are increased in the same ratio. Additional holes 39 are then added between the 28 existing holes to achieve the 13% ratio of normal hole area to interior surface area of the ignition tube. The inclination angle 43 are spaced over the entire series of holes, again from 90° to 30°, with respect to axis 23.

It is also contemplated as part of the present invention that the design for a particular gun dimension may be fine tuned or made more efficient. This is achieved by enlarging, if necessary, the diameter of individual holes, without change in the pattern, thus retaining all of the previously described features of the invention except to modify the 13% area ratio. This modification is contemplated as part of the present invention because the pattern is to act on the longitudinally attenuated plasma to substantially decreasing the amplitude of any reflected shock in the plasma stream. The decision to adjust the area ratio is based upon examination of the pressure wave form achieved in the combustion chamber. The hole diameters modulate the ignition and plasma-propellant interaction. If a more rapid initial pressure rise is desired, then the holes are made larger, but only by enough so that pressure waves are not introduced. If a pressure boost is desired later in the combustion, the hole size is maintained the same or only increased by a lesser amount. Further control of the plasma-propellant interaction may be achieved by decreasing that radiative component from the plasma that passes through the ignition tube wall. This can be done by using a thin film of absorbent coating on the outside surface of the tube. Such is not necessary for the 20 mm gun described herein but is contemplated for larger designs as needed.

In order to demonstrate the efficacy of the present invention, a series of test firings were made, using a 20 mm electrothermal chemical combustion gun. The ignition tube of the present invention was used in place of an ignition tube that had none of the features of the invention tube. That old tube produced traveling waves, specifically pressure waves or pressure oscillations, that were caused by pressure variations in the combustion chamber. The gun with the old tube was not even suitable for screening various propellants. Fitted with the ignition tube of this invention, however, the gun provided a standardized test procedure that was very satisfactory.

This is represented in a series of test firings comprised a total of 21 individual experiments with the gun shown and described in FIG. 2. Propellants used were a ball powder, a gel, a gelled liquid propellant and single-perf solid grains. The load density and plasma energy were varied in the experiments as a variety of successful firings were achieved. Several of the test firings are described below and the resulting data presented in Table I following the experiments.

EXPERIMENT ONE

Shot 21 of the series of tests was made with a gelled liquid propellant MX 46 at a loading density of 1.3 g/cc, which entirely filled the available space in the combustion chamber. Two pressure tracings and the plasma current trace show that the pressure rise had only local variations and there was no evidence of combustion chamber pressure waves.

EXPERIMENT TWO

Shot 20 employed a gelled liquid propellant MX 46 having a loading density of 1.1 g/cc. This amount did not entirely fill the combustion chamber, so, in order to uniformly distribute the gelled propellant, it was contained in a very thin wall plastic bag, in fact a 'sandwich baggy', which was flattened after loading and wrapped around the ignition tube. In the traces of this firing, there was a small superimposed pressure spike at about 0.5 millisecond. Again, however, there was no evidence of combustion chamber pressure waves.

EXPERIMENT THREE

Shot 19 employed even less of the same gelled liquid propellant. In this firing, 0.9 g/cc were used but in this case the 'baggy' was divided into four pockets by heat sealing. The traces show three pressure traces and the plasma current trace without any pressure waves occurring.

EXPERIMENT FOUR

Shot 15 differed from Shot 19 in that the propellant was Ball Powder by Olin at a loading density of 0.7 g/cc. Three pressure traces and the current trace show no pressure waves occurring.

EXPERIMENT FIVE

Finally, Shot 14 was made, differing from Shot 15 only by the use of an experimental gel at a loading density of 0.7 g/cc. Once again, three pressure traces and the current trace show no pressure waves occurring.

TABLE I

| EXPERIMENT | MAX KPSI | TIME, msec. | Pressure Waves |
|---|---|---|---|
| One | 49.92 | 0.65 | none |
| Two | 44.92 | 2.43 | none |
| Three | 34.16 | 1.11 | none |
| Four | 24.59 | 1.15 | none |
| Five | 25.62 | 1.10 | none |

As can be seen from Table I, various maximum pressures were achieved at different elapsed times without production of pressure waves. Pressure tracings that extended to 7 milliseconds showed a smooth curve dropping from the maximum pressure with no pressure waves, indicating that the present invention provides for plasma ignition and combustion of the propellant under optimum conditions.

The present invention provides an ignition tube design for Electrothermal Chemical Combustion guns that handles the plasma-propellant interaction so as to not produce pressure waves or oscillations in the combustion chamber. This invention may be applied to all sizes and designs of such guns, as the invention provides for adjustment of the coupling of plasma to propellant to optimize performance. Other experiments with 30 mm guns using the same plasma with different propellants produced excellent P/T traces showing the efficacy of the present invention. Several different power sources have been used and at least five different propellants have been employed. Not only Ball Powder but liquid propellants such as XM 46 and solid propellants have been shown to be effective in the present invention.

While particular embodiments of the present invention have been illustrated and described herein, it is not intended that these illustrations and descriptions limit the invention. Changes and modifications may be made herein without departing from the scope and spirit of the following claims.

We claim:

1. An ignition tube for use with electrothermal chemical combustion ignition of propellants for projectiles in guns, comprising;

a tube positionable in a combustion chamber for receiving plasma ignition from a plasma chamber, said tube being adapted to release plasma upon contact by plasma ignition electrical energy pulses, said tube having a proximal end for association with said plasma chamber and a distal end for association with said projectile;

said tube having a central bore and an increasing exit area from said bore extending from said proximal end toward said distal end; said exit area including a plurality of radially extending orifices having a decreased angle of inclination to the longitudinal axis from said proximal end to said distal end, such that the orifices form a spiral pattern on the circumference of the tube.

2. The tube of claim 1, wherein said ignition tube is formed from high density polyethylene.

3. The tube of claim 1, wherein said orifices are oriented to uniformly act upon the longitudinally attenuated plasma, thereby substantially decreasing the amplitude of any reflected shock in the plasma stream.

4. The tube of claim 1, wherein said orifices are oriented in a pattern with increasing orifice proximity and decreasing angle of inclination to the longitudinal axis to facilitate exit of the plasma from the combustion chamber to act on the propellant and thus on the projectile.

5. The tube of claim 1 wherein said orifices are oriented in a spiral pattern with increasing orifice proximity and decreasing angle of inclination to the longitudinal axis to create turbulence at a plasma-propellant interface to improve local site ignition.

6. The of claim 5 wherein the ratio of the total orifice normal-to-flow area to the interior surface area of the ignition tube is about 13%.

7. A gun for firing projectiles, comprising:

a plasma chamber adapted to release plasma ignition electrical energy pulses along a longitudinal axis;

a combustion chamber for receiving said plasma ignition pulses from said plasma chamber;

an ignition tube positioned in said chamber, said tube having a proximal end for receiving said pulses in said combustion chamber and a distal end for association with said projectile;

said tube having a central bore and an increasing exit area from said bore extending from said proximal end toward said distal end;

said exit area including a plurality of radially extending orifices having a decreased angle of inclination to the longitudinal axis from said proximal end to said distal end, such that said orifices form a spiral pattern on the circumference of the tube.

8. The gun of claim 7, wherein said ignition tube is formed from high density polyethylene.

9. The gun of claim 7, wherein said orifices are oriented to uniformly act upon the longitudinally attenuated plasma, thereby substantially decreasing the amplitude of any reflected shock in the plasma stream.

10. The gun of claim 7, wherein said orifices are oriented in a pattern with increasing orifice proximity and decreasing angle of inclination to the longitudinal axis to facilitate exit of the plasma from the combustion chamber to act on the propellant and thus on the projectile.

11. The gun of claim 7 wherein said orifices are oriented in a spiral pattern with increasing orifice proximity and decreasing angle of inclination to the longitudinal axis to create turbulence at a plasma-propellant interface to improve local site ignition.

12. The gun of claim 11 wherein the ratio of the total orifice normal-to-flow area to the interior surflce area of the ignition tube is about 13%.

13. In a gun for firing projectiles, said gun including a plasma chamber adapted to release plasma ignition electrical energy pulses along a longitudinal axis, and a combustion chamber for receiving said plasma ignition pulses from said plasma chamber, the improvement comprising:

an ignition tube positioned in said chamber, said tube having a proximal end for receiving said pulses in said combustion chamber and a distal end for association with said projectile;

said tube having a central bore and an increasing exit area from said bore extending from said proxLmal end toward said distal end;

said exit area including a plurality of radially extending orifices having a decreased angle of inclination to the longitudinal axis from said proximal end to said distal end, such that said orifices form a spiral pattern on the circumference of the tube.

14. The gun of claim 13, wherein said ignition tube is formed from high density polyethylene.

15. The gun of claim 13, wherein said orifices are oriented to uniformly act upon the longitudinally attenuated plasma, thereby substantially decreasing the amplitude of any reflected shock in the plasma stream.

16. The gun of claim 13, wherein said orifices are oriented in a pattern with increasing orifice proximity and decreasing angle of inclination to the longitudinal axis to facilitate exit of the plasma from the combustion chamber to act on the propellant and thus on the projectile.

17. The gun of claim 13 wherein said orifices are oriented in a spiral pattern with increasing orifice proximity and decreasing angle of inclination to the longitudinal axis to create turbulence at a plasma-propellant interface to improve local site ignition.

18. The gun of claim 17 wherein the ratio of the total orifice normal-to-flow area to the interior surface area of the ignition tube is about 13%.

* * * * *